US010124374B2

(12) United States Patent
Lee

(10) Patent No.: US 10,124,374 B2
(45) Date of Patent: Nov. 13, 2018

(54) BOARD CLEANING APPARATUS

(76) Inventor: Hi-Man Lee, Gyeongsangbuk-do (KR)

( * ) Notice: Subject to any disclaimer, the term of this patent is extended or adjusted under 35 U.S.C. 154(b) by 80 days.

(21) Appl. No.: 13/257,533

(22) PCT Filed: Mar. 8, 2010

(86) PCT No.: PCT/KR2010/001414
§ 371 (c)(1),
(2), (4) Date: Sep. 19, 2011

(87) PCT Pub. No.: WO2010/110539
PCT Pub. Date: Sep. 30, 2010

(65) Prior Publication Data
US 2012/0005846 A1 Jan. 12, 2012

(30) Foreign Application Priority Data
Mar. 23, 2009 (KR) ..... 10-2009-0024526

(51) Int. Cl.
*B08B 1/02* (2006.01)
*B08B 1/04* (2006.01)
*B08B 5/04* (2006.01)
*B08B 15/02* (2006.01)
*B28B 11/22* (2006.01)

(52) U.S. Cl.
CPC ..... *B08B 1/04* (2013.01); *B08B 1/02* (2013.01); *B08B 5/043* (2013.01); *B08B 15/02* (2013.01); *B28B 11/22* (2013.01)

(58) Field of Classification Search
CPC .. B28B 11/22; B98B 1/00; B98B 1/02; B98B 1/04; B98B 5/00; B98B 5/04; B98B 5/043; B98B 5/046; B98B 15/00; B98B 15/02; B98B 2215/00; B98B 2215/006
USPC ..... 15/306.1, 308, 309.1, 309.2, 77, 88.2
See application file for complete search history.

(56) References Cited

U.S. PATENT DOCUMENTS 1,474,672 A * 11/1923 Heuze ..... 451/160
1,587,444 A * 6/1926 Thomas ..... 68/5 D
2,291,553 A * 7/1942 Mathy et al. ..... 15/77
(Continued)

FOREIGN PATENT DOCUMENTS

FR 2622816 * 5/1989
JP 10-137399 A 5/1998
(Continued)

OTHER PUBLICATIONS

English Language Abstract of JP 10-137399 A.
(Continued)

*Primary Examiner* — Mark Spisich
(74) *Attorney, Agent, or Firm* — Hershkovitz & Associates, PLLC; Abe Hershkovitz

(57) ABSTRACT

A board cleaning apparatus is provided which removes foreign substances sticking to the surface of a board for fabricating precast concrete articles using a brush which rotates in a horizontal direction, and in which a suction duct is provided to suck dust particles generated when the foreign substances are removed. The board cleaning apparatus includes a feeder unit that feeds a board, a power generator that generates power, and a power transmission that transmits power generated by the power generator, wherein a brush is disposed at a lower end portion of the power generator in a vertical direction from the board.

11 Claims, 6 Drawing Sheets

(56) References Cited

U.S. PATENT DOCUMENTS

| | | | | | |
|---|---|---|---|---|---|
| 2,310,541 | A | * | 2/1943 | O'Brien et al. | 68/13 R |
| 2,621,445 | A | * | 12/1952 | Wallace | 451/65 |
| 2,635,653 | A | * | 4/1953 | Hennell | 144/115 |
| 3,946,454 | A | * | 3/1976 | Holm et al. | 15/77 |

FOREIGN PATENT DOCUMENTS

| | | | |
|---|---|---|---|
| JP | 2000-140773 | * | 5/2000 |
| JP | 2006-167529 | A | 6/2006 |
| JP | 2006-184388 | A | 7/2006 |

OTHER PUBLICATIONS

English Language Abstract of JP 2006-167529 A.
English Language Abstract of JP 2006-184388 A.
International Search Report of PCT/KR2010/001414 dated Oct. 25, 2010.

* cited by examiner

BOARD CLEANING APPARATUS

BACKGROUND OF THE INVENTION

Field of the Invention

The present invention relates, in general, to a board cleaning apparatus and, more particularly, to a board cleaning apparatus which removes foreign substances sticking to the surface of a board (or mold plate, which will be hereinafter referred to as a "board") for fabricating precast concrete articles using a brush which rotates in a horizontal direction, and in which a suction duct is provided to suck dust particles generated during the removal of foreign substances.

Description of the Related Art

Although precast concrete articles had conventionally been manually fabricated by only a small quantity production method that produced few products, the production method is currently changing to a multi-product batch production method, because there is greater demand for precast concrete articles in the various fields of architecture, public works, or interior/exterior decoration that is taking place alongside the advances in industrialization.

Therefore, a board serving to mold, cure, and move concrete products has been developed which is disposed in the bottom of a mold for continuously casting concrete products so that concrete blocks or bricks can be mass produced.

However, there is a problem in that foreign substances such as a concrete residue get irregularly stuck to the surface of the board which was used for casting the concrete product, so that if the board is reused for the production of the concrete product, the produced concrete product has an irregular bottom, degrading the value of the product.

Thus, in order to solve this problem, an apparatus for removing foreign substances has been developed in which a sharp iron blade is fixed above a board that is moving, or otherwise, as shown in FIG. 1, a brush that rotates about a horizontal axis is mounted above a board that is moving so as to remove the foreign substances from the surface of the board. The apparatus includes feeder sections that are mounted above a base frame at certain distances to frictionally feed a board B, a removing section 40 that removes foreign substances sticking to the board B, and a height-adjuster 41 that adjusts the height of the removing section 40.

However, the blade type apparatus has a problem in that it is difficult to adjust the position of the blade. That is, if the blade is located at a lower position, the board B is engaged against the sharp blade, resulting in the process having to be interrupted or damaging the board. On the other hand, if it is located at a higher position, foreign substances on the surface of the board are not completely removed, resulting in detracting from the value of a concrete product.

In addition, the brush type apparatus has a problem in that it comes into line-contact with the board B, so that foreign substances stuck to the board B cannot be completely removed because of a small contact area and a short contact time. Further, if the feed rate of the board B is slowed down in order to increase the contact time, the production per unit time is reduced, increasing the cost of production. Furthermore, if the brush is worn out, adherence of the brush to the board B is reduced, so that the position of the brush has to be adjusted in order to increase the adherence.

In addition, when the concrete residue stuck to the surface of the board B is removed, a great quantity of dust particles are generated, which deteriorates a working environment and has a bad influence upon the health of workers.

SUMMARY OF THE INVENTION

Accordingly, the present invention has been made keeping in mind the above problems occurring in the related art, and the present invention is intended to propose a board cleaning apparatus, in which a plurality of rotating brushes, each mounted to an axis that is formed vertically from a board, is used so that the brushes are brought into surface-contact with the board and the contact area and the time is made longer, thereby completely removing the foreign substances from the board.

The present invention is also intended to provide a board cleaning apparatus, which is provided with a dust collector which sucks dust particles generated when removing foreign substances stuck to a board, thereby improving a working environment.

In order to achieve the above objects, according to one aspect of the present invention, there is provided a board cleaning apparatus including: a feeder unit that feeds a board, a power generator that generates power, and a power transmission that transmits power generated by the power generator, wherein a brush is disposed at a lower end portion of the power generator in a vertical direction from the board.

In an exemplary embodiment, the brush is mounted to a brush connector installed to the lower end portion of the power generator.

In an exemplary embodiment, the brush connector has therein a brush axis to which an elastic body is mounted to elastically force the brush downwards.

In an exemplary embodiment, the brush is composed of a row of a plurality of brushes, and the brush connector is composed of one or two rows of brush connectors.

In an exemplary embodiment, the brush connectors are configured such that the respective rows of brushes rotate in opposite directions from each other.

In an exemplary embodiment, a suction duct is provided in one side or both sides of the power generator.

In an exemplary embodiment, an anti-diffusion section is formed in a distal end of the suction duct.

In an exemplary embodiment, the anti-diffusion section includes an upper portion and a lower portion, wherein the upper portion is made from a hard plate, and the lower portion is made from a soft plate.

In an exemplary embodiment, the upper portion includes an upper plate and a lower plate, which are coupled by a hinge, and a magnet is provided in the upper or lower plate.

In an exemplary embodiment, the apparatus includes a dust collector connected to the suction duct, and a dust box is provided in the dust collector.

According to the above configuration of the present invention, since the plurality of rotating brushes, mounted to the axes formed vertically from the board, come into surface-contact with the board, the contact area and time of contact are increased, thereby providing the effect of completely removing the foreign substances stuck to the board and thus producing a hard, fine, good-quality concrete product.

In addition, the dust collector provided in the apparatus sucks dust particles generated when the concrete residue stuck to the surface of the board is removed, thereby improving a working environment and a worker's health as well.

BRIEF DESCRIPTION OF THE DRAWINGS

The above and other objects, features and advantages of the present invention will be more clearly understood from the following detailed description when taken in conjunction with the accompanying drawings, in which.

DETAILED DESCRIPTION OF THE INVENTION

Figure 1:
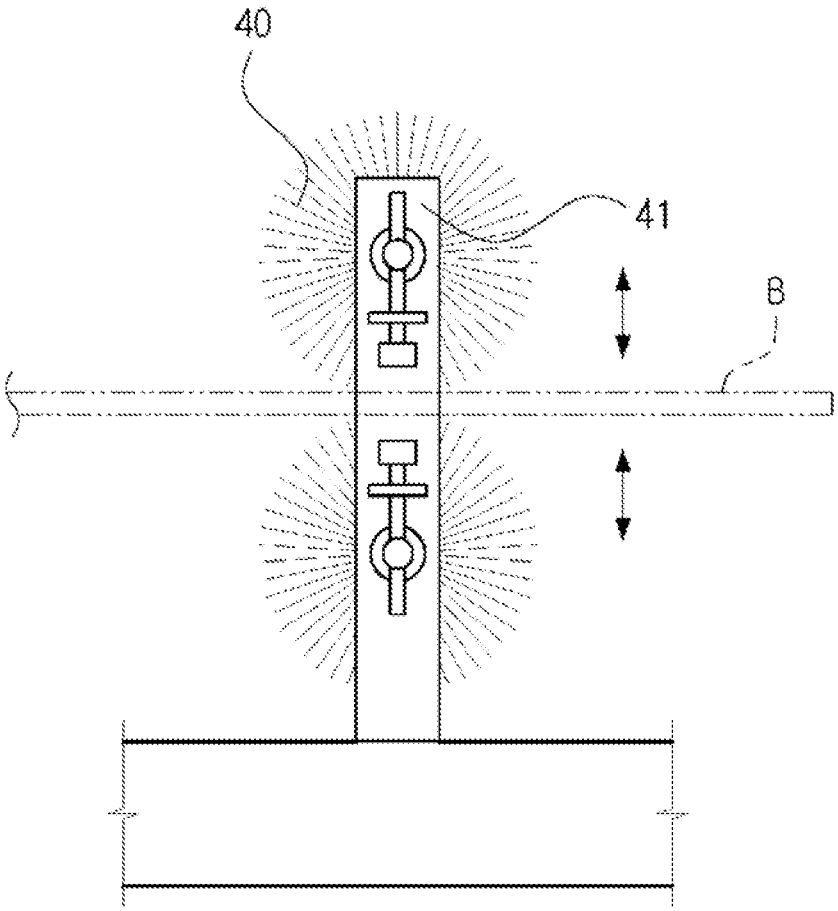
FIG. 1 PRIOR ART
FIG. 1 is a side view of a conventional board cleaning apparatus.

Reference will now be made in greater detail to a preferred embodiment of the invention, an example of which is illustrated in the accompanying drawings. Wherever possible, the same reference numerals will be used throughout the drawings and the description to refer to the same or like parts. An overlapping description of the same parts will be omitted. Furthermore, it should be understood that the embodiment of the present invention may be changed to a variety of embodiments and the scope and spirit of the present invention are not limited to the embodiment described hereinbelow.

Figure 2:
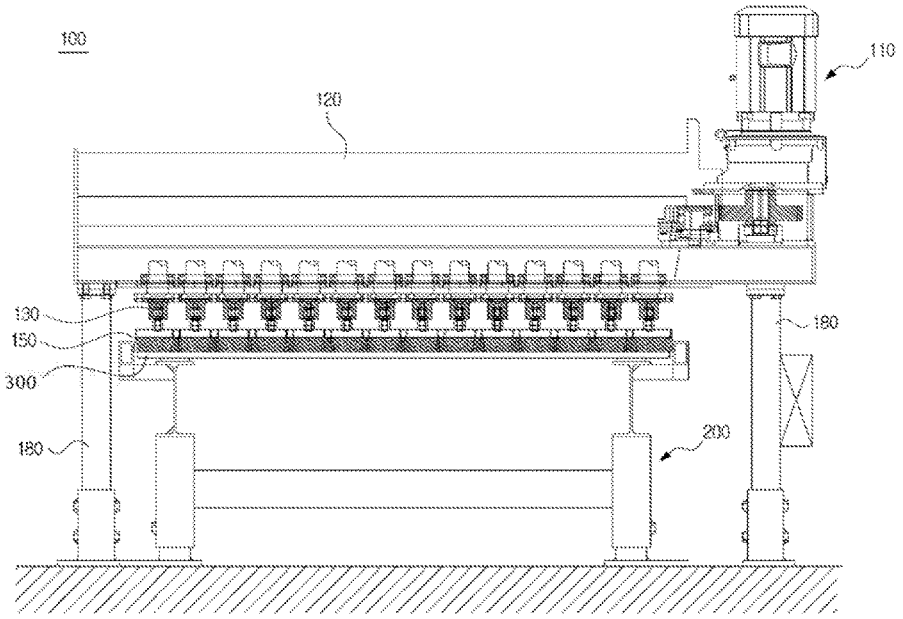
FIG. 2 is a front view of a board cleaning apparatus according to the present invention.
Figure 3:
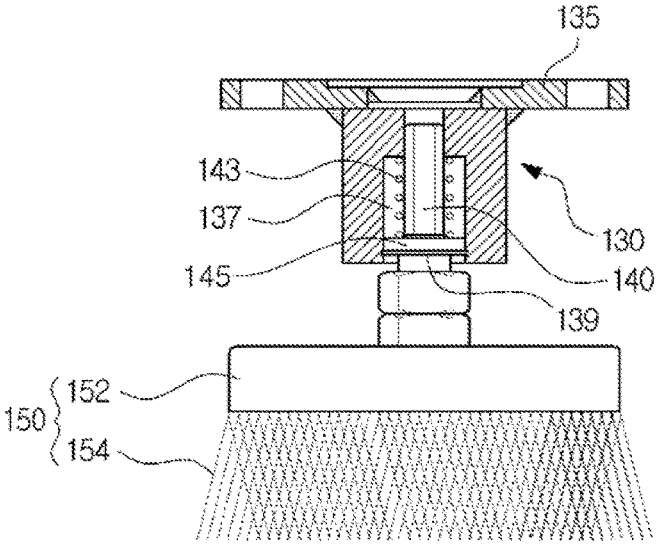
FIG. 3 is a cross-sectional view of a brush connector of the board cleaning apparatus according to the present invention.
Figure 4:
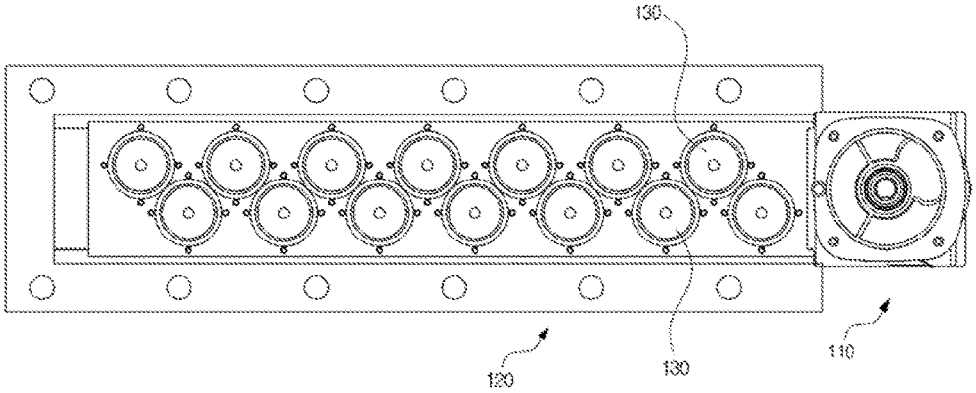
FIG. 4 is a view showing the state of the brush connectors being disposed in the board cleaning apparatus according to the present invention.
Figure 5:
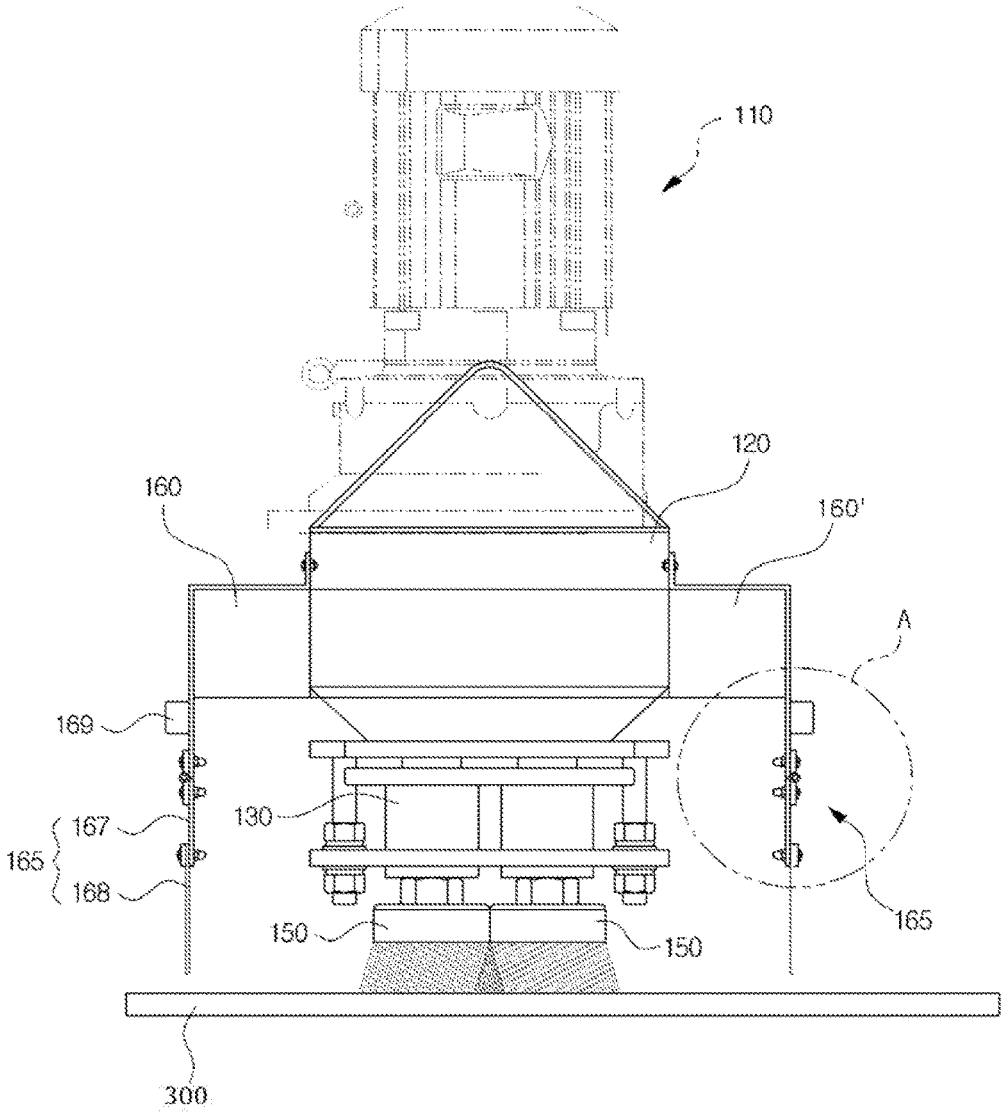
FIG. 5 is a side view showing the state of a suction duct being disposed in the board cleaning apparatus according to the present invention.
Figure 6:
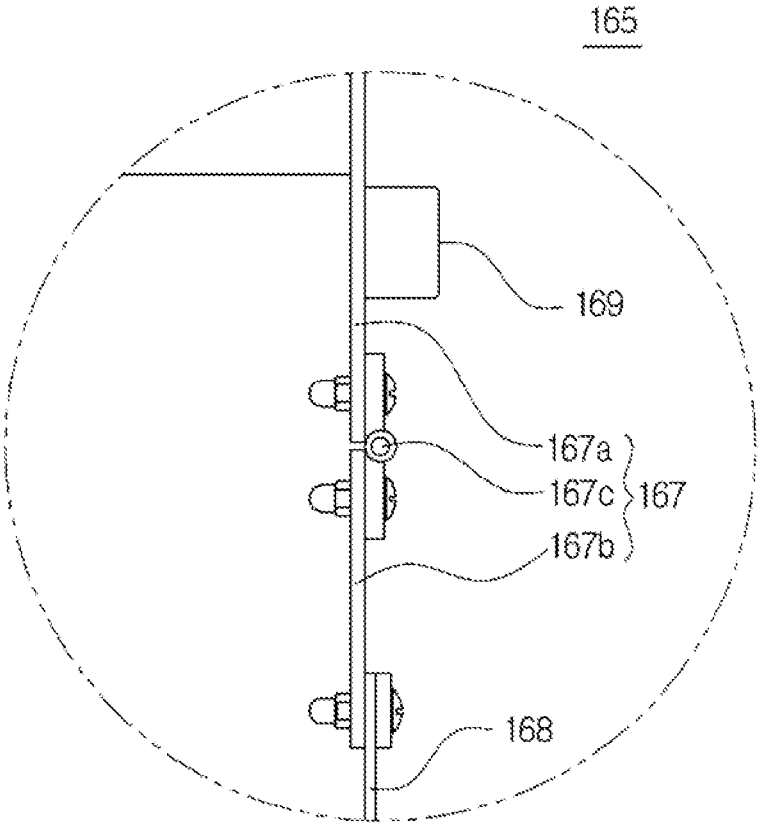
FIG. 6 is an enlarged view of an anti-diffusion section according to the present invention.
Figure 7:
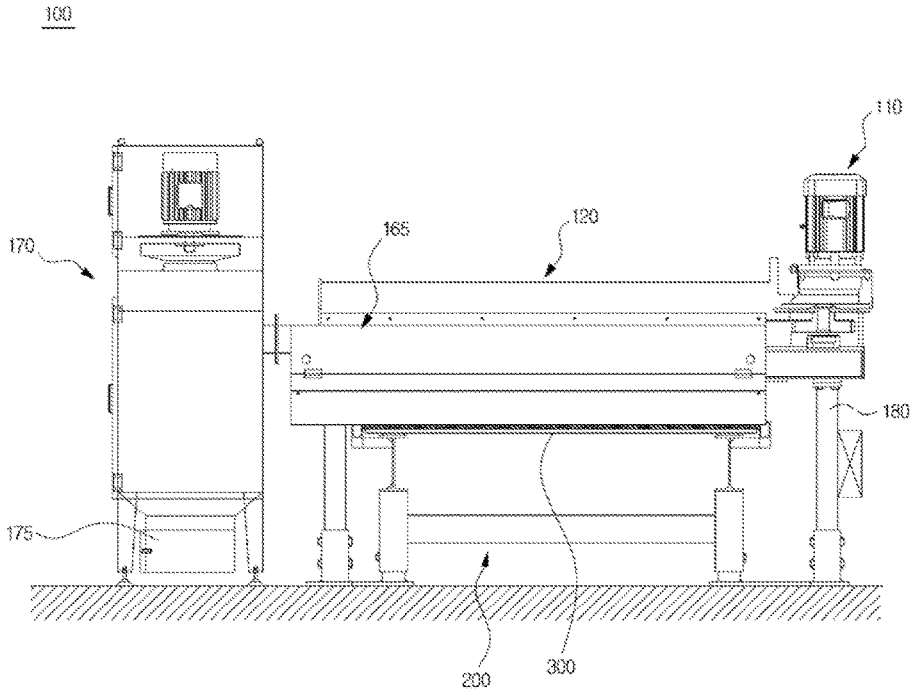
FIG. 7 is a front view showing the state of a dust collector being disposed in the board cleaning apparatus according to the present invention.

FIG. 2 is a front view of a board cleaning apparatus according to the present invention, FIG. 3 is a cross-sectional view of a brush connector of the board cleaning apparatus according to the present invention, FIG. 4 is a view showing the state of the brush connectors being disposed in the board cleaning apparatus according to the present invention, FIG. 5 is a side view showing the state of a suction duct being disposed in the board cleaning apparatus according to the present invention, FIG. 6 is an enlarged view of an anti-diffusion section according to the present invention, and FIG. 7 is a front view showing the state of a dust collector being disposed in the board cleaning apparatus according to the present invention.

The present invention is directed to the board cleaning apparatus, which as shown in FIG. 2, generally includes a power generator 110, a power transmission 120, a brush connector 130, a brush 150, and a support stage 180.

Here, the power generator 110 is disposed in one side of the power transmission 120 in the longitudinal direction. The power generator 110 may preferably be a motor.

The power transmission 120 serves to transmit power generated by the power generator 110 to the brush connector 130. Although the power transmission may have a variety of gears depending on the position at which the power transmission 120 is coupled with the power generator 110, the power transmission 120 may have a gear drive, such as a bevel gear, a worm gear, etc, or a transmission, such as a chain or belt, to transmit power, since it is usual that the power generator 110 and the power transmission 120 are mounted such that they intersect each other at right angles.

In the meantime, in the process of fabricating concrete products such as bricks or blocks, the board cleaning apparatus 100 is mounted to a feeder unit 200 that feeds a board 300 using a conveyor system. The board cleaning apparatus 100 is supported by a support stage 180, which is mounted at a lower end portion of the power transmission 120, above the feeder unit 200.

The brush connectors 130 are mounted to the lower end portion of the power transmission 120, wherein as shown in FIG. 4, the respective brush connectors 130 are provided on the upper end thereof with a flange 135, through which the brush connector is firmly fixed to the power transmission 120.

Here, the brush connector 130 is provided therein with a brush axis 140 such that the brush axis can be rotated by power transmitted from the power transmission 120.

Here, the brush connector 130 has therein an elastic body reservoir 137 in which an elastic body 143 is received such that it is mounted to the brush axis 140.

In addition, the brush axis 140 has, in the lower end, an engaging step 145, which is elastically forced downwards by the elastic body 143 above the engaging step. In addition, the brush connector 130 supports the elastic body 143 such that the elastic body elastically forces an object downwards, so that the brush 150, which is mounted to a lower end of the brush axis 140, presses the board 300 against its upper surface.

In the related art, as shown in FIG. 1, as the brush becomes worn out, the position of the brush should be adjusted such that it is brought into close contact with the board B. Compared to this, according to the board cleaning apparatus 100 of the present invention, the position of the brush 150 is elastically adjusted by the action of the elastic body 143, which eliminates the troublesome work of adjusting the position of the brush. In addition, it is configured such that the brush 150 presses the board 300 against the upper surface thereof, thereby more cleanly removing foreign substances stuck to the board 300.

Here, a support plate 139 is provided in a lower end of the elastic body reservoir 137 in order to prevent the brush axis 140 from moving downwards over a certain distance, i.e. beyond the lower portion of the elastic body reservoir.

The brush 150 is mounted to the lower end of the brush axis 140, and includes a disc-shaped fixing portion 152, which is mounted to the brush axis 140, and a metallic brush portion 154 for removing foreign substances stuck to the board 300. The brush 150 presses the board 300 against the upper surface thereof while rotating, so as to easily remove concrete residue stuck to the surface of the board 300.

In the meantime, as shown in FIG. 4, the brush connector 130 is composed of a row of a plurality of brush connectors in the breadth direction of the board 300. Here, the brush connectors may be arranged into one or at least two rows of the brush connectors. In addition, the length of the row of the brush connectors 130 is provided longer than the width of the board 300, so that the concrete residue stuck to the surface of the board 300 can be cleanly removed at once.

Here, if the brush connectors consist of two rows of brush connectors, the brush connectors are configured such that the respective rows of brush connectors rotate in opposite directions from each other. This allows the foreign substances stuck to the surface of the board 300 to be removed more cleanly. Thus, when using the clean board 300, from which the foreign substances have been cleanly removed, a hard, fine, good-quality concrete product can be made.

In addition, as shown in FIG. 5, a suction duct 160 and/or 160' is mounted in one side or both sides of the power transmission 120. The suction duct 160 or 160' serves to suck dust particles which are generated when removing the foreign substances stuck to the surface of the board 300, thereby maintaining the work environment in a pleasant state, and thus improving the working efficiency and the workers' health as well.

Here, the suction duct 160 or 160' is provided, in the distal end, with an anti-diffusion section 165, which includes an upper portion 167 and a lower portion 168 so as to prevent dust particles, which are generated when removing the foreign substances stuck to the board 300, from dissipating to the outside.

Here, since the upper portion 167 is formed in the proximity of the suction duct 160 or 160', the upper portion is made from a hard plate in order not to be affected by the force of suction of the suction duct 160. The lower portion 168 is attached in the lower side of the upper portion 167. The lower portion 168 is made from a soft plate such as PVC such that it is bent by the suction force of the suction duct 160 or 160', thereby allowing external air to be easily introduced into the inside thereof.

In the meantime, as shown in FIG. 6, the upper portion 167 is composed of an upper plate 167*a* and a lower plate 167*b*, which are pivotally coupled by a hinge 167*c*. This configuration eliminates the work of disassembling the anti-diffusion section 165 in order to clean or repair the board cleaning apparatus 100.

Here, since the hinge 167*c* is mounted outside the upper plate 167*a* and lower plate 167*b* so that the upper and lower plates 167*a* and 167*b* can be folded not towards the inside thereof, but towards the outside thereof, even when the suction duct 160 generates the suction force, they cannot fold towards the inside.

In addition, a magnet 169 is provided in one side of the upper plate 167*a* or the lower plate 167*b* in order to fix the folded anti-diffusion section 165.

In addition, as shown in FIG. 7, a dust collector 170 is mounted in one side of the power transmission 120 such that it is connected with the suction duct 160. There is a dust box 175 provided in the dust collector 170 to collect and receive dust particles sucked by the suction duct 160.

Here, the size of the dust box 175 is such that it is easily handled by a worker, so that the worker can easily perform the work of disposing of the dust particles contained in the dust box.

Now a description will be made of the operation of the board cleaning apparatus of the present invention. The board cleaning apparatus 100 is mounted to the feeder unit 200 of a conveyor system in the process of fabricating concrete products such as bricks or blocks, in order to remove the foreign substances stuck to the board 300 that is being moved by the feeder unit 200.

Here, the power generator 110 is provided in one side of the power transmission 120, which is supported by the support stage 180 mounted in the lower end, in the longitudinal direction thereof, and the power transmission 120 transmits power generated by the power generator 110 to the brush connector 130, which is mounted in the lower end of the power transmission 120.

Then, the brush axis 140, which is mounted in the brush connector 130 such that it is connected with the power transmission 120, rotates because of the power transmitted from the power transmission 120, and concurrently rotates the brush 150 mounted in the lower end of the brush axis 140.

Here, the elastic body reservoir 137, which is provided in the brush connector 130, receives the elastic body 143 such that it is mounted to the brush axis 140, and supports it from the lower portion thereof, and the engaging step 145 provided in the lower end of the brush axis 140 is elastically forced downwards by the elastic body 143 above the engaging step.

Thus, the brush 150 mounted to the lower end of the brush axis 140 comes into close contact with the upper surface of the board 300, so that the foreign substances stuck to the surface of the board 300 can be removed more cleanly. In addition, although the brush is being worn out, there is no need for hard adjustment of the position of the brush 150.

In the meantime, the brush connectors 130 are arranged in one or at least two rows of multiple brush connectors. If arranged in two rows of brush connectors, it is configured such that the respective two rows of brush connectors rotate in opposite directions from each other, allowing the foreign substances stuck to the surface of the board 300 to be removed more cleanly.

In addition, the suction duct 160 and/or 160' is mounted in one side or both sides of the power transmission 120, and the suction duct 160 or 160' is provided, in the distal end, with the anti-diffusion section 165, which includes the upper portion 167 consisting of a hard plate and the lower portion 168 consisting of a soft plate, thereby sucking dust particles, which are generated when removing the foreign substances stuck to the board 300, and thus improving the work environment and also the health of workers.

In the meantime, it is configured such that the upper portion 167 is composed of the upper plate 167*a* and the lower plate 167*b*, which are coupled by the hinge such that they can be folded, which enables the anti-diffusion section 165 to be folded in order to clean or repair the board cleaning apparatus 100.

In addition, the dust collector 170 is mounted in one side of the power transmission 120 such that it is connected with the suction duct 160. The dust box 175 is provided in the dust collector 170, so that a worker can separately collect and dispose of the dust particles sucked by the suction duct 160.

Here, the dust box 175 is of a size that is easy for a worker to handle, so that the worker can easily perform the work of disposing of the dust particles contained in the dust box.

As set forth before, the present invention provides a board cleaning apparatus which removes foreign substances sticking to the surface of the board for fabricating precast concrete articles using a brush which rotates in a horizontal direction, and in which the suction duct is provided to suck dust particles generated when the foreign substances are removed.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A board cleaning apparatus comprising:

a feeder unit that feeds a board;

a power generator that generates power;

a power transmission that transmits power generated by the power generator, wherein a brush is disposed at a lower end portion of the power generator in a vertical direction from the board, wherein a suction duct is provided on at least one side of the power generator, wherein an anti-diffusion section is formed in a distal end of the suction duct and includes an upper portion and a lower portion, the upper portion being made from a hard plate and the lower portion being made from a soft plate, wherein the upper portion includes an upper plate and a lower plate which are coupled by a hinge, and a magnet is provided in the upper or lower plate.

2. The board cleaning apparatus according to claim 1, wherein the brush is mounted to a brush connector installed to the lower end portion of the power generator.

3. The board cleaning apparatus according to claim 2, wherein the brush connector has therein a brush axis to which an elastic body is mounted to elastically force the brush downwards.

4. The board cleaning apparatus according to claim 3, wherein the brush is composed of a row of a plurality of brushes, and the brush connector is composed of one or two rows of brush connectors.

5. The board cleaning apparatus according to claim 4, wherein the brush connectors are configured such that the respective rows of brushes rotate in opposite directions from each other.

6. The board cleaning apparatus according to claim 2, wherein the brush is composed of a row of a plurality of brushes, and the brush connector is composed of one or two rows of brush connectors.

7. The board cleaning apparatus according to claim 6, wherein the brush connectors are configured such that the respective rows of brushes rotate in opposite directions from each other.

8. The board cleaning apparatus according to claim 1, wherein the brush is composed of a row of a plurality of brushes, and a brush connector is composed of one or two rows of brush connectors.

9. The board cleaning apparatus according to claim 8, wherein the brush connectors are configured such that the respective rows of brushes rotate in opposite directions from each other.

10. The board cleaning apparatus according to claim 1, wherein the apparatus includes a dust collector connected to the suction duct, and a dust box is provided in the dust collector.

11. A board cleaning apparatus comprising:

a feeder unit that feeds a board;

a power generator that generates power;

a power transmission that transmits power generated by the power generator, wherein a brush is disposed at a lower end portion of the power generator in a vertical direction from the board, wherein the brush is mounted to a brush connector installed to the lower end portion of the power generator, wherein the brush connector has therein a brush axis to which an elastic body is mounted to elastically force the brush downwardly, wherein a suction duct is provided on at least one side of the power generator, wherein an anti-diffusion section is formed in a distal end of the suction duct and includes an upper portion, wherein the upper portion includes an upper plate and a lower plate, which are coupled by a hinge, and a magnet is provided in the upper or lower plate.

* * * * *